US005873647A

United States Patent [19]

Kurtz et al.

[11] Patent Number: 5,873,647

[45] Date of Patent: Feb. 23, 1999

[54] NOZZLE MOUNTED LAMP

[76] Inventors: Rodney Kurtz, 53 Bear Hill Rd., North Andover, Mass. 01845; Gilbert B. Guerin, 32 Belcher St., Essex, Mass. 01924

[21] Appl. No.: 824,998

[22] Filed: Mar. 27, 1997

[51] Int. Cl.[6] ..... F21V 33/00

[52] U.S. Cl. ..... 362/96; 362/101; 362/234; 362/245

[58] Field of Search ..... 362/96, 101, 110, 362/112, 234, 237, 240, 241, 245, 247, 268; 239/18, 19, 20; 222/113

[56] References Cited

U.S. PATENT DOCUMENTS

| | | | |
|---|---|---|---|
| 1,903,974 | 4/1933 | Brink | 239/18 |
| 1,924,150 | 8/1933 | Browne | 240/6.46 |
| 1,960,114 | 5/1934 | Lindsay | 88/39 |
| 2,071,242 | 2/1937 | Todd | 240/2 |
| 2,105,632 | 1/1938 | Bernesser | 240/2 |
| 2,183,462 | 12/1939 | Mestre | 240/1.4 |
| 2,330,592 | 9/1943 | Kendrick | 240/2 |
| 3,337,134 | 8/1967 | Bond | 239/19 |
| 3,748,456 | 7/1973 | Brien | 240/2.1 |
| 3,784,804 | 1/1974 | Sabatelli et al. | 240/2 FD |
| 4,283,757 | 8/1981 | Nalbandian et al. | 362/120 |
| 4,348,715 | 9/1982 | Christensen et al. | 362/109 |
| 4,591,953 | 5/1986 | Oram | 362/33 |
| 4,729,070 | 3/1988 | Chiu | 362/33 |
| 5,143,436 | 9/1992 | Baylor et al. | 362/32 |

OTHER PUBLICATIONS

"The Series 3000 Abrasive Blast Light," Western Technology, Inc., brochure, 4 pages (Apr. 1986).

"Fiber–Lite®—Illumination Systems for Microscopy, Laboratory and Machine Vision," brochure, Dolan–Jenner Industries, Inc. (1994).

Drawing of Complete Light Assembly, Western Technology, Inc., P/N 3200 (Nov. 28, 1982).

*Primary Examiner*—Y My Quach

*Attorney, Agent, or Firm*—Hamilton, Brook, Smith & Reynolds, P.C.

[57] ABSTRACT

A lamp for a nozzle includes an annular housing having an outer peripheral wall and an inner peripheral wall, the inner peripheral wall defining a central cavity extending through the housing. The central cavity lies along a central axis and enables the housing to be mounted circumferentially around the nozzle. A securing device is connected to the housing for securing the housing to the nozzle. A lighting unit is positioned within the housing and encircles the central cavity. An annular shaped first lens is positioned over the lighting unit. A retaining member secures and seals the first lens to the outer and inner peripheral walls of the housing for hermetically sealing the lighting unit within the housing.

26 Claims, 5 Drawing Sheets

NOZZLE MOUNTED LAMP

BACKGROUND

Sandblasting is typically performed by directing a stream of abrasive materials expelled from a hand held nozzle onto the surfaces of a work piece. Such work is often performed in closed booths and other dimly lit areas. One current approach for increasing the light level to improve visibility for the person operating the sandblasting equipment is to mount a halogen lamp to one side of the sandblasting nozzle. The drawback of such a lighting arrangement is that as the operator maneuvers the sandblasting nozzle, the sandblasting nozzle can rotate, thereby rotating the lamp about the axis of the sandblasting nozzle. This can move the beam of light emitted by the lamp away from the location desired to be illuminated. Since the lamp is offset from the axis of the sandblasting nozzle, the weight of the lamp may also cause the sandblasting nozzle to twist in the operator's hands if not held tightly. The lamp also employs a supply of pressurized air to cool the lamp as well as to remove contaminants, tending to make the sandblasting nozzle/lighting system relatively complex and awkward to handle.

SUMMARY OF THE INVENTION

The present invention provides a lamp for mounting to a nozzle which provides consistent illumination and is easy to handle even in harsh environments. The lamp includes a housing having an outer peripheral wall and an inner peripheral wall. The inner peripheral wall defines a central cavity extending through the housing. The central cavity lies along a central axis and enables the housing to be mounted circumferentially around the nozzle. A securing device is connected to the housing for securing the housing to the nozzle. A lighting unit is positioned within the housing and encircles the central opening. A first lens having an outer periphery and an inner periphery is positioned over the lighting unit. The inner periphery of the first lens defines a central opening through the first lens. A retaining member secures and seals the outer periphery and inner periphery of the first lens to respective outer and inner peripheral walls of the housing to hermetically seal the lighting unit within the housing.

In preferred embodiments, a second lens having an outer periphery and an inner periphery is positioned over the first lens for protecting the first lens. The inner periphery of the second lens defines a central opening through the second lens. The housing, first lens and second lens are generally annular in shape. The lighting unit preferably includes a plurality of light sources and a reflector for reflecting light emitted by the light sources. The lighting unit is positioned within an annular recess formed in the housing concentric with the central cavity. A power supply provides power to the lighting unit and is electrically connected to the lighting unit by a circuit board. The securing device consists of at least one and preferably a series of thumb screws protruding into the central cavity of the housing for clamping the lamp to the nozzle.

The present invention provides a relatively simple lamp for mounting to a nozzle which is suitable for use in harsh environments. Since the lighting unit of the present invention lamp encircles the nozzle, the lamp can provide consistent lighting even when the nozzle is rotated. It also is balanced so as not to cause rotation of the nozzle. In addition, the lighting unit is hermetically sealed within the housing making the present invention lamp explosion proof and allows its use in explosive environments.

BRIEF DESCRIPTION OF THE DRAWINGS

The foregoing and other objects, features and advantages of the invention will be apparent from the following more particular description of preferred embodiments of the drawings in which like reference characters refer to the same parts throughout the different views. The drawings are not necessarily to scale, emphasis instead being placed upon illustrating the principles of the invention.

DETAILED DESCRIPTION OF THE PREFERRED EMBODIMENTS

Figure 1:
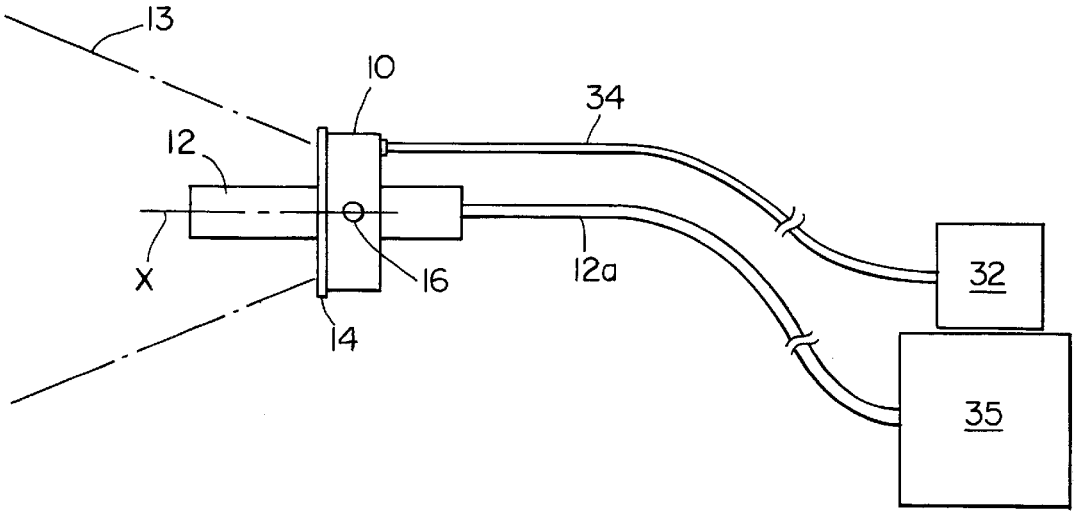
FIG. 1 is a side view of the present invention lamp mounted to a sandblasting nozzle.
Figure 2:
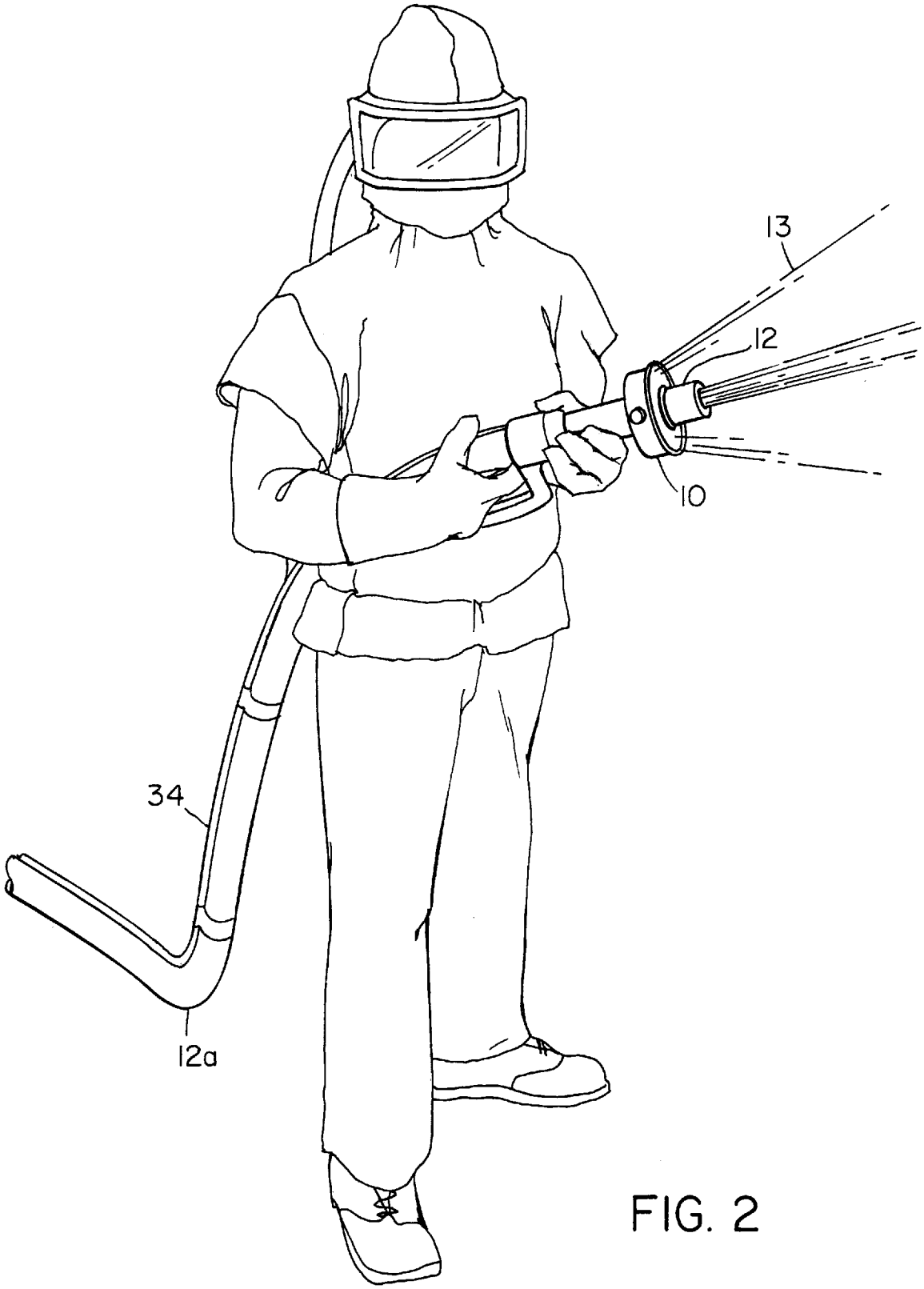
FIG. 2 is a perspective view showing the present invention in use.
Figure 3:
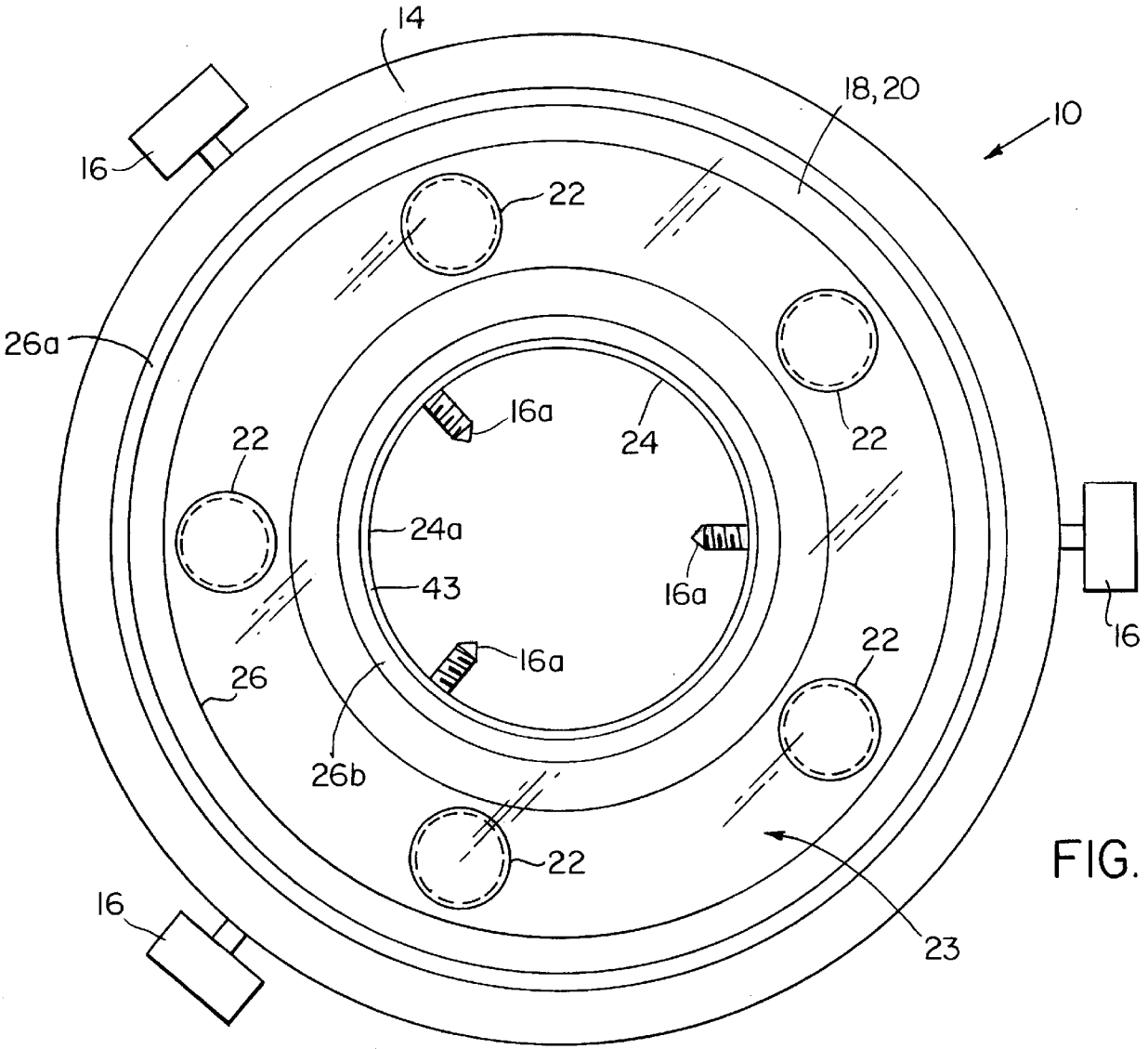
FIG. 3 is a front view of the present invention lamp.
Figure 5:
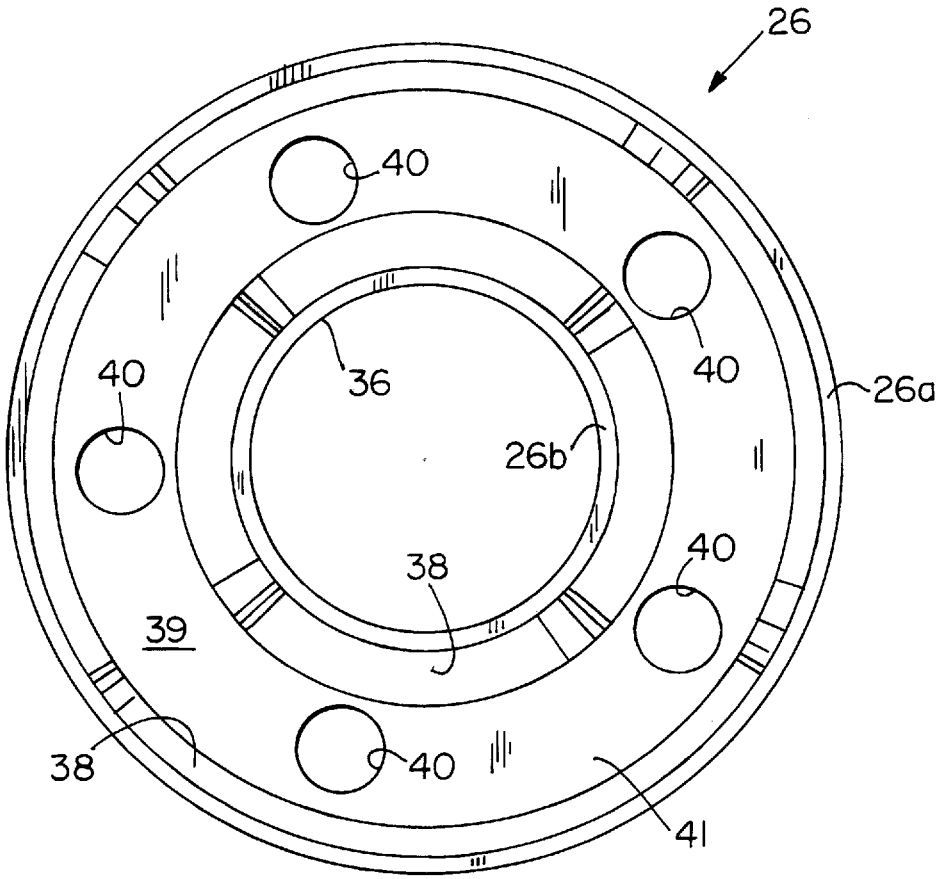
FIG. 5 is a front view of the reflector for the lamp.
Figure 6:
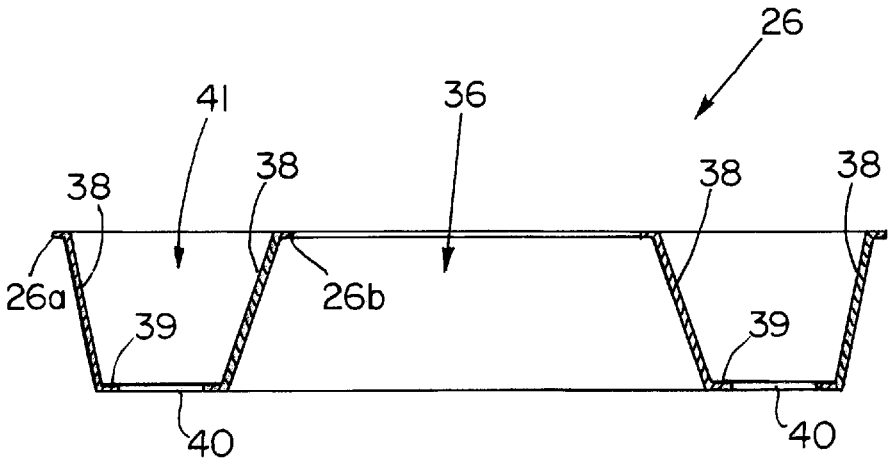
FIG. 6 is a side sectional view of the reflector of FIG. 5.

Referring to FIGS. 1 and 2, the present invention lamp 10 is mounted circumferentially around the outer surface of a hand held sandblasting nozzle 12. Lamp 10 is secured to sandblasting nozzle 12 by a series of thumb screws 16. A hose 12*a* supplies the sandblasting nozzle 12 with a mixture of pressurized air and abrasives from a sandblasting power unit 35. Hose 12*a* can be as long as 100 feet, thereby providing the sandblasting operator with the ability to maneuver around the work area. An electrical cord 34 provides lamp 10 with electrical power from power supply 32. Power supply 32 is preferably located with the sandblasting power unit 35 and converts AC power into DC power for lamp 10. Alternatively, power supply 32 can be a battery pack and be worn on the waist of the sandblasting operator. This is less preferable because battery packs require periodic recharging.

Figure 4:
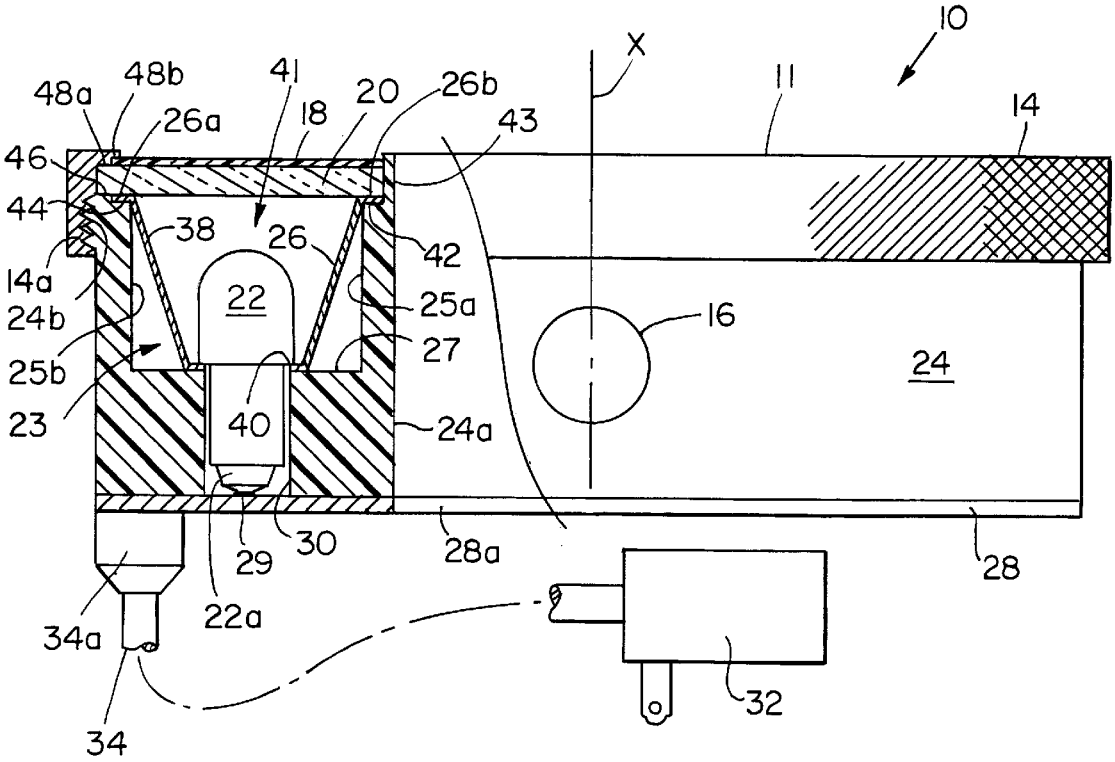
FIG. 4 is a side view of the present invention lamp with a portion broken away.

In use, lamp 10 directs a ring of light 13 forwardly from nozzle 12 to illuminate the work piece or work area being sandblasted. The ring of light 13 is preferably concentric with respect to nozzle 12 and central axis X. This allows nozzle 12 to be maneuvered without noticeably changing the level of illumination provided on the work piece or work area even when nozzle 12 is rotated. Lamp 10 does not tend to cause nozzle 12 to twist about axis X because lamp 10 is evenly balanced relative to nozzle 12 about axis X. Lamp 10 provides sufficient illumination for the sandblasting operator to see while working indoors in dim light conditions such as in a sandblasting booth or outdoors during the night. In addition, lamp 10 is shock and impact resistant making lamp 10 durable. Occasionally, due to dusty conditions, the full intensity of lamp 10 is too bright and produces glare. In such a case, the intensity of lamp 10 can be reduced by adjusting a rheostat located at connector 34*a* (FIG. 4). The rheostat enables lamp 10 to be infinitely adjustable from zero to full intensity.

A more detailed description of lamp 10 now follows. Referring to FIGS. 3, 4, 5 and 6, lamp 10 includes a generally annular-shaped housing 24 having a central cavity 24*a* passing through the housing 24 along central·axis X. Housing 24 is about 4.37 inches in diameter, 1.58 inches high and is made of impact resistant plastic. Three equally spaced thumb screws 16 are threaded through housing 24 and have tips 16*a* which protrude into the central cavity 24*a* for clamping lamp 10 around nozzle 12. Although three thumb screws 16 are preferred, alternatively, more than three or less than three thumb screws 16 can be employed. Housing 24 includes a generally annular recess 23 (FIG. 4) positioned concentrically about central cavity 24*a*. Recess 23 is open towards the front 11 of lamp 10 and is bounded by an inner sidewall 25*a*, an outer sidewall 25*b* and a bottom wall 27 of housing 24.

Preferably, five low power light bulbs 22 are positioned within recess 23 and concentrically encircle central cavity 24*a*. Light bulbs 22 are preferably rated for 5.95 volts, 0.5 amperes and 3.0 MSCD. The five light bulbs 22 yield a total light intensity of 15 MSCD at 14.9 watts of power. A series of holes 30 pass through the bottom wall 27 within recess 23 for accepting the stems 22*a* of light bulbs 22. Holes 30 are equally spaced apart from each other and are concentric with central cavity 24*a*. Light bulbs 22 do not require an air flow for cooling since the light bulbs 22 are of low power. Although five light bulbs 22 are preferred, alternatively, more than five or less than five light bulbs 22 can be employed.

An annular reflector 26 (FIGS. 5 and 6) having a central cavity 36 is positioned within the recess 23 for reflecting light generated by light bulbs 22. Reflector 26 includes an inner trough 41 having reflective inner walls 38 which angle outwardly from the bottom 39 of trough 41 to reflect light from light bulbs 22. Reflector 26 concentrates light to approximately 3 feet in front of nozzle 12. Inner and outer flanges 26*a* and 26*b* located at the top of reflector 26 rest on shoulders 44 and 42 of housing 24, respectively for seating reflector 26 within recess 23. The bottom 39 of trough 41 includes a series of holes 40 passing therethrough for allowing light bulbs 22 to extend through and from the reflector 26 into holes 30. Reflector 26 is preferably molded from plastic and coated with a reflective silver surface. Alternatively, reflector 26 can be fabricated from sheet metal or molded from reflective white plastic.

Two annular lenses 18 and 20 cover and protect the reflector 26 and light bulbs 22 positioned within recess 23. Lens 20 rests upon ridge 46 of the outer sidewall 25*b* of housing 24 as well as flanges 26*a*/26*b* of reflector 26. Lens 18 is thinner than lens 20 and covers lens 20 to protect lens 20 from scratching. The inner diameters of lenses 18/20 abut the neck 43 of inner sidewall 25*a* of housing 24. Lens 20 is made of Pyrex and is impact resistant while lens 18 is made from scratch resistant plastic. When lens 18 is damaged, lens 18 is peeled from lens 20 and replaced. Lens 20 preferably has an outer diameter of 4.37/4.36 inches, an inner diameter of 1.895/1.885 inches and a thickness of 0.125 inches. The outer diameter of lens 20 is concentric with the inner diameter by 0.005 inches. Lens 18 preferably has an outer diameter of 4.16/4.17 inches, an inner diameter of 1.885/1.895 inches and a thickness of 0.020 inches.

An annular retaining ring 14 including an internal thread 14*a* engages an external thread 24*b* of housing 24 for clamping lenses 18/20 over reflector 26, light bulbs 22 and housing 24. Retaining ring 14 includes stepped shoulders 48*a* and 48*b* for engaging the outer edges of lenses 20 and 18, respectively. Retaining ring 14 has a knurled outer surface enabling retaining ring 14 to be sufficiently tightened by hand. Retaining ring 14 tightens the lenses 18/20 over housing 24 and reflector 26 with enough force to hermetically seal the interior of housing 24 from the exterior environment. This prevents dust, abrasives and other contaminants from entering lamp 10. This also prevents lamp 10 from igniting explosive environments. If needed, rubber gaskets can be employed to provide a more secure seal. Retaining ring 14 is preferably made of impact resistant plastic but alternatively can be made of metal such as steel, aluminum or brass. In addition, retaining ring 14 can include only one lens engaging shoulder. In such a case, lens 18 would have the same outer diameter as lens 20.

An annular circuit board 28 having a central opening 28*a* is mounted to the bottom of housing 24 and includes electrical contacts 29 corresponding with the stems 22*a* of light bulbs 22 for electrically contacting and providing power to light bulbs 22. Circuit board 28 is sealed to housing 24 to prevent contaminants from entering therein. Reflector 26 spring mounts light bulbs 22 to circuit board 28 for mechanical shock protection. The electrical contacts 29 on the circuit board 28 are connected together in a parallel circuit to prevent all the light bulbs 22 from losing power if one light bulb 22 burns out. Electrical contacts 29 can be spring loaded to provide a secure electrical connection with light bulbs 22. Electrical power from power supply 32 is supplied to circuit board 28 by electrical cord 34 and connector 34*a* mounted to circuit board 28. Connector 34*a* is of a strain-relief cable connector design to avoid tensile breakage. Power supply 32 is preferably rated for a 120 VAC, 60 hertz input with a 6 VDC, 2.5 amperes output. The rheostat at connector 34*a* is preferably rated for 25 watts and 25 ohms.

In order to replace a burned out light bulb 22, the electrical power from power supply 32 is first turned off. Retaining ring 14 is then unscrewed from housing 24. Lenses 18/20 and reflector 26 are removed. The burned out light bulb 22 is replaced with a new light bulb 22. Reflector 26, lenses 18/20 and retaining ring 14 are reassembled to housing 24. This can all be accomplished without removing lamp 10 from sandblasting nozzle 12.

Figure 7:
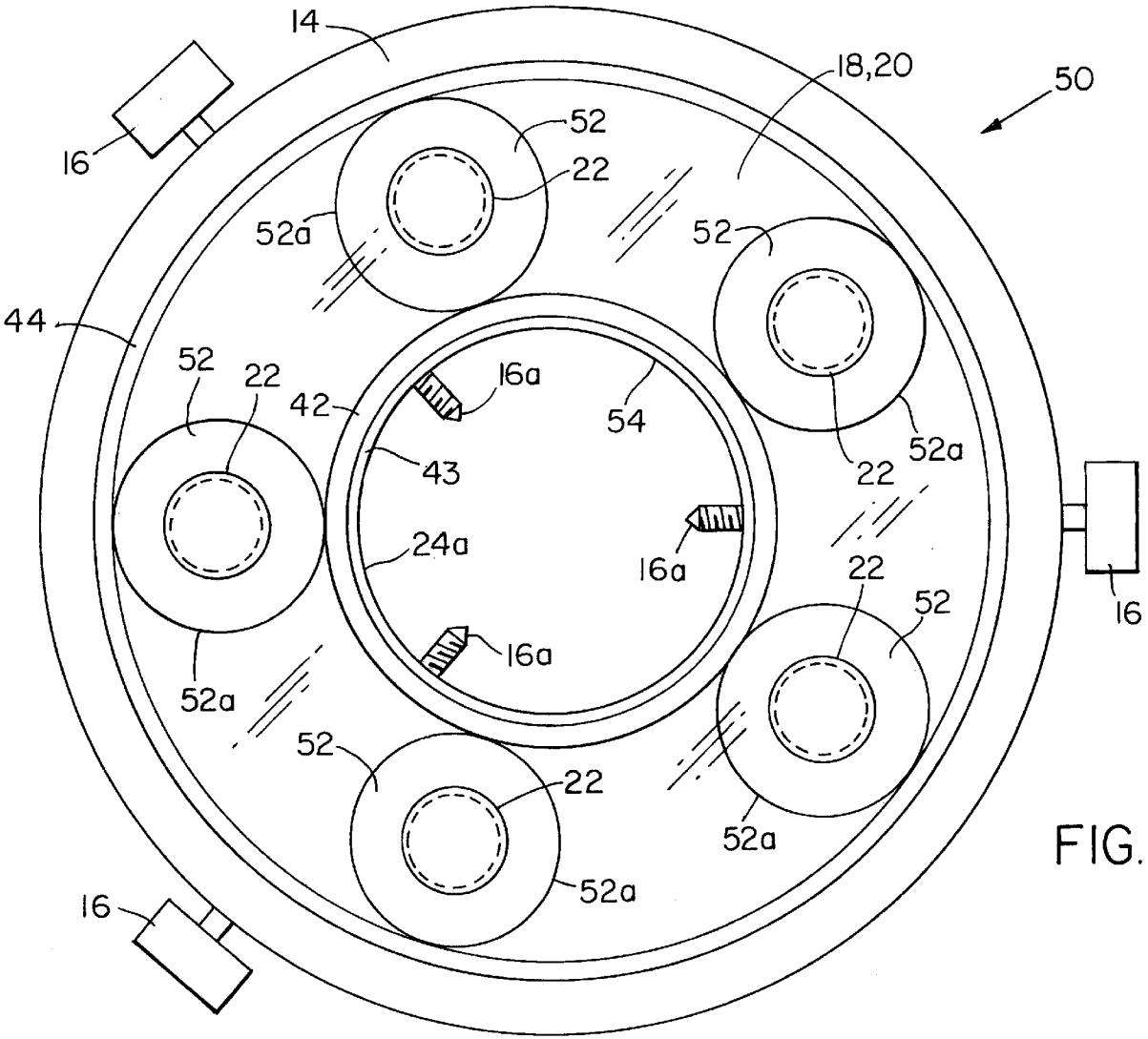
FIG. 7 is a front view of another preferred lamp.

Referring to FIG. 7, lamp 50 differs from lamp 10 in that housing 54 includes a series of recesses 52*a* for receiving individual reflectors 52. Reflectors 52 are made from the same materials used for reflector 26. In another preferred embodiment, housing 54 can include an annular recess such as recess 23 in housing 24. In such a case, reflectors 52 are positioned in the annular recess. In still another preferred embodiment, the reflectors 52 can be omitted. Housing 54 would then include recesses 52*a* that are shaped for reflecting light from light bulbs 22. The recesses 52*a* are either coated with a reflective coating or are colored white.

Although lamps 10 and 50 have been shown to include light bulbs 22, alternatively, LEDs can be substituted for the light bulbs 22.

EQUIVALENTS

While this invention has been particularly shown and described with references to preferred embodiments thereof, it will be understood by those skilled in the art that various changes in form and details may be made therein without departing from the spirit and scope of the invention as defined by the appended claims. For example, although the present invention lamps 10 and 50 have been described for use with sandblasting nozzles, lamps 10 and 50 can be used in any application where materials are accelerated or vacuumed through a hose and nozzle in dusty or dim lighting environments such as on spray paint guns, vacuum machines, etc. Also, although lamp 10 has been described to have multiple light bulbs 22, alternatively, a single annular light bulb can be employed. In addition, although lamps 10 and 50 have been depicted to have flat front and rear surfaces, alternatively, the front and rear surfaces can be curved. Furthermore, the central cavity 24*a* and outer perimeter of housing 24 are preferably circular but, alternatively, can have other suitable shapes such as triangular, square, hexagonal, oval, clover-shaped, etc. Finally, although particular dimensions and components have been specified, these can be varied depending upon the application at hand.

What is claimed is:

1. A lamp for a nozzle comprising:

a housing having an outer peripheral wall and an inner peripheral wall, the inner peripheral wall defining a central cavity extending through the housing, the central cavity lying along a central axis and enabling the housing to be mounted circumferentially around the nozzle;

a securing device connected to the housing for securing the housing to the nozzle;

a lighting unit positioned within the housing and encircling the central cavity;

a first lens positioned over the lighting unit, the first lens having an outer periphery and an inner periphery, the inner periphery defining a central opening through the first lens;

a retaining member for securing and sealing the outer periphery and inner periphery of the first lens to respective outer and inner peripheral walls of the housing to hermetically seal the lighting unit within the housing; and a second lens positioned over the first lens for protecting the first lens, the second lens having an outer periphery and an inner periphery, the inner periphery defining a central opening through the second lens.

2. The lamp of claim 1 in which the lighting unit comprises a plurality of light sources.

3. The lamp of claim 2 in which the lighting unit further comprises a reflector for reflecting light.

4. The lamp of claim 3 further comprising a power supply electrically connected to the lighting unit.

5. The lamp of claim 4 further comprising a circuit board electrically connected between the lighting unit and the power supply.

6. The lamp of claim 5 in which the reflector serves to spring mount the light sources to the circuit board.

7. The lamp of claim 5 further comprising:

a strain-relief type electrical connector mounted to the circuit board; and an electrical cable extending between the electrical connector and the power supply.

8. The lamp of claim 1 in which the housing is generally annular in shape, the lighting unit being positioned within an annular recess formed in the housing concentric with the central cavity.

9. The lamp of claim 1 in which the nozzle is a sandblasting nozzle.

10. The lamp of claim 1 further comprising a rheostat electrically connected to the lighting unit for adjusting the intensity of the lighting unit.

11. The lamp of claim 1 in which the housing is impact resistant.

12. A lamp for a nozzle comprising:

a generally annular shaped housing having an outer peripheral wall and an inner peripheral wall, the inner peripheral wall defining a central cavity extending through the housing, the central cavity lying along a central axis and enabling the housing to be mounted circumferentially around the nozzle;

a securing device connected to the housing for securing the housing to the nozzle;

a lighting unit positioned within the housing and encircling the central cavity;

a first generally annular shaped lens positioned over the lighting unit, the first lens having an outer periphery and an inner periphery, the inner periphery defining a central opening through the first lens;

a second generally annular shaped lens positioned over the first lens for protecting the first lens, the second lens having an outer periphery and an inner periphery, the inner periphery defining a central opening through the second lens; and a retaining member for securing and sealing the outer periphery and inner periphery of the first and second lenses to respective outer and inner peripheral walls of the housing to hermetically seal the lighting unit within the housing.

13. The lamp of claim 12 in which the lighting unit comprises a plurality of light sources.

14. The lamp of claim 13 in which the lighting unit further comprises a reflector for reflecting light.

15. The lamp of claim 12 in which the lighting unit is positioned within an annular recess formed in the housing concentric with the central cavity.

16. The lamp of claim 12 further comprising a power supply electrically connected to the lighting unit.

17. The lamp of claim 16 further comprising a circuit board electrically connected between the lighting unit and the power supply.

18. A method of providing light for a nozzle comprising the steps of:

circumferentially mounting a housing for a lamp around the nozzle, the housing having an outer peripheral wall and an inner peripheral wall, the inner peripheral wall defining a central cavity extending through the housing and lying along a central axis, the central cavity enabling the housing to be mounted around the nozzle;

securing the housing to the nozzle with a securing device connected to the housing;

positioning a lighting unit within the housing, the lighting unit encircling the central cavity;

positioning a first lens over the lighting unit, the first lens having an outer periphery and an inner periphery, the inner periphery defining a central opening through the first lens;

securing and sealing the outer periphery and inner periphery of the first lens to respective outer and inner peripheral walls of the housing with a retaining member for hermetically sealing the lighting unit within the housing; and positioning a second lens over the first lens for protecting the first lens, the second lens having an outer periphery and an inner periphery, the inner periphery defining a central opening through the second lens.

19. The method of claim 18 further comprising the step of providing the lighting unit with a plurality of light sources.

20. The method of claim 18 further comprising the step of reflecting light emitted by the lighting unit with a reflector.

21. The method of claim 18 further comprising the step of electrically connecting the lighting unit to a power supply with a circuit board connected to the housing.

22. A lamp for a nozzle comprising:

a housing having an outer peripheral wall and an inner peripheral wall, the inner peripheral wall defining a central cavity extending through the housing, the central cavity lying along a central axis and enabling the housing to be mounted circumferentially around the nozzle;

a securing device connected to the housing and securing the housing to the nozzle;

a lighting unit comprising a light source and a reflector positioned within the housing and encircling the central cavity;

a circuit board connected to the housing and electrically connected to the lighting unit, the light source being spring mounted to the circuit board by the reflector;

a first lens positioned over the lighting unit, the first lens having an outer periphery and an inner periphery, the inner periphery defining a central opening through the first lens; and a retaining m ember for securing and sealing the outer periphery and inner periphery of the first lens to respective outer and inner peripheral walls of the housing to hermetically seal the lighting unit within the housing.

23. The lamp of claim 22 further comprising a power supply electrically connected to the lighting unit.

24. The lamp of claim 23 further comprising:

a strain-relief type electrical connector mounted to the circuit board; and an electrical cable extending between the electrical connector and the power supply.

25. A lamp for a hand-held nozzle comprising:

a housing having an outer peripheral wall and an inner peripheral wall, the inner peripheral wall defining a central cavity extending through the housing, the central cavity lying along a central axis and enabling the housing to be mounted circumferentially around the nozzle;

a securing device connected to the housing for securing the housing to the nozzle, said securing device comprising a screw threaded through the housing into the central cavity and engaging the nozzle to clamp the housing onto the nozzle;

a lighting unit positioned within the housing and encircling the central cavity;

a first lens positioned over the lighting unit, the first lens having an outer periphery and an inner periphery, the inner periphery defining a central opening through the first lens; and a retaining member for securing and sealing the outer periphery and inner periphery of the first lens to respective outer and inner peripheral walls of the housing to hermetically seal the lighting unit within the housing.

26. A lamp for a hand-held sandblasting nozzle comprising:

a housing having an outer peripheral wall and an inner peripheral wall, the inner peripheral wall defining a central cavity extending through the housing, the central cavity lying along a central axis and enabling the housing mounted circumferentially around the nozzle;

a securing device engaging the nozzle and connected to the housing for securing the housing to the nozzle;

a lighting unit positioned within the housing and encircling the central cavity;

a first lens positioned over the lighting unit, the first lens having an outer periphery and an inner periphery, the inner periphery defining a central opening through the first lens; and a retaining member for securing and sealing the outer periphery and inner periphery of the first lens to respective outer and inner peripheral walls of the housing to hermetically seal the lighting unit within the housing.

* * * * *

UNITED STATES PATENT AND TRADEMARK OFFICE

CERTIFICATE OF CORRECTION

PATENT NO. : 5,873,647
DATED : February 23, 1999
INVENTOR(S) : Rodney Kurtz and Gilbert B. Guerin

It is certified that error appears in the above-identified patent and that said Letters Patent is hereby corrected as shown below:

Column 6, Claim 20, line 57, after "reflector" insert ---in the housing---.

Signed and Sealed this

Twenty-ninth Day of June, 1999

*Attest:*

*Attesting Officer*

Q. TODD DICKINSON

*Acting Commissioner of Patents and Trademarks*